US011183131B2

(12) United States Patent
Li et al.

(10) Patent No.: US 11,183,131 B2
(45) Date of Patent: Nov. 23, 2021

(54) DEVICE FOR GENERATING GRAY-SCALE DRIVE TABLE AND METHOD THEREOF, DISPLAY PANEL AND METHOD FOR DRIVING THE SAME

(71) Applicants: Hefei BOE Display Technology Co., Ltd., Hefei (CN); BOE TECHNOLOGY GROUP CO., LTD., Beijing (CN)

(72) Inventors: Tao Li, Beijing (CN); Liugang Zhou, Beijing (CN); Ke Dai, Beijing (CN); Yizhan Han, Beijing (CN); Jianwei Sun, Beijing (CN); Yulong Xiong, Beijing (CN); Zhenlin Qu, Beijing (CN)

(73) Assignees: Hefei BOE Display Technology Co., Ltd., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/968,532

(22) PCT Filed: Jan. 7, 2020

(86) PCT No.: PCT/CN2020/070754
§ 371 (c)(1),
(2) Date: Aug. 7, 2020

(87) PCT Pub. No.: WO2020/147619
PCT Pub. Date: Jul. 23, 2020

(65) Prior Publication Data

US 2021/0043154 A1 Feb. 11, 2021

(30) Foreign Application Priority Data

Jan. 14, 2019 (CN) ..... 201910031692.9

(51) Int. Cl.
*G09G 3/36* (2006.01)

(52) U.S. Cl.
CPC ..... *G09G 3/3607* (2013.01); *G09G 3/3614* (2013.01); *G09G 3/3688* (2013.01);
(Continued)

(58) Field of Classification Search
CPC combination set(s) only.
See application file for complete search history.

(56) References Cited

U.S. PATENT DOCUMENTS 9,959,802 B1 5/2018 Jiang et al.
10,515,598 B2 12/2019 Hwang et al.
(Continued)

FOREIGN PATENT DOCUMENTS

CN 1632647 A 6/2005
CN 101615382 A 12/2009
(Continued)

OTHER PUBLICATIONS

International Search Report and Written Opinion for International Application No. PCT/CN2020/070754 dated Mar. 26, 2020.
(Continued)

*Primary Examiner* — Nan N Chow
(74) *Attorney, Agent, or Firm* — Thomas | Horstemeyer, LLP

(57) ABSTRACT

A gray-scale drive table generating device is described that includes a sampling circuit configured to collect a first voltage between a drive electrode of a sub-pixel of a positive-frame and a common electrode and a second voltage between a drive electrode of a sub-pixel of a negative-frame and the common electrode in a display panel in each gray-scale; a processing circuit configured to generate a trigger signal when a voltage difference between the first voltage and the second voltage is greater than a voltage
(Continued)

threshold; an adjustment circuit configured to adjust drive gray-scales of the sub-pixel of the positive-frame and/or the sub-pixel of the negative-frame in response to the trigger signal to make the voltage difference less than the voltage threshold; and a recording circuit configured to generate an adjusted gray-scale drive table according to the drive gray-scales of the sub-pixel of the positive-frame and the sub-pixel of the negative-frame in each gray-scale.

16 Claims, 8 Drawing Sheets

(52) U.S. Cl.
CPC ..... *G09G 2300/0426* (2013.01); *G09G 2320/0233* (2013.01); *G09G 2320/0257* (2013.01); *G09G 2320/0271* (2013.01); *G09G 2320/0285* (2013.01)

(56) References Cited

U.S. PATENT DOCUMENTS

| | | | | |
|---|---|---|---|---|
| 2009/0322799 | A1 | 12/2009 | Guo et al. | |
| 2010/0156963 | A1* | 6/2010 | Shiomi | G09G 3/3648 345/691 |
| 2013/0257845 | A1* | 10/2013 | Chaji | G09G 3/3258 345/212 |
| 2017/0287418 | A1 | 10/2017 | Hwang et al. | |
| 2020/0168149 | A1* | 5/2020 | Liu | G09G 3/3233 |
| 2020/0227006 | A1* | 7/2020 | Yao | G09G 3/2003 |
| 2021/0043154 | A1* | 2/2021 | Li | G09G 3/3607 |
| 2021/0097926 | A1* | 4/2021 | Sun | G09G 3/2074 |

FOREIGN PATENT DOCUMENTS

| | | | |
|---|---|---|---|
| CN | 104347048 | A | 2/2015 |
| CN | 104882113 | A | 9/2015 |
| CN | 105529011 | A | 4/2016 |
| CN | 106898323 | A | 6/2017 |
| CN | 107068098 | A | 8/2017 |
| CN | 107274843 | A | 10/2017 |
| CN | 105529011 | B | 4/2018 |
| CN | 108847194 | A | 11/2018 |
| CN | 109461423 | A | 3/2019 |
| EP | 3229228 | A1 | 10/2017 |
| EP | 3229228 | B1 | 10/2019 |
| GN | 103106591 | A | 5/2013 |
| JP | 2008197349 | A | 8/2008 |
| WO | 2019242118 | A1 | 12/2019 |

OTHER PUBLICATIONS

First Office Action for CN Patent Application No. 201910031692.9 dated Mar. 30, 2020.

* cited by examiner

| | Initial gray-scale | | | | | | | | | |
|---|---|---|---|---|---|---|---|---|---|---|
| | | 0 | 1 | 31 | 63 | 127 | 191 | 223 | 254 | 255 |
| Target gray-scale | 0 | 0 | 0 | 0 | 0 | 0 | 0 | 0 | 0 | 0 |
| | 1 | 1 | 1 | 1 | 1 | 1 | 1 | 1 | 1 | 1 |
| | 31 | 31 | 31 | 31 | 31 | 31 | 31 | 31 | 31 | 31 |
| | 63 | 63 | 63 | 63 | 63 | 63 | 63 | 63 | 63 | 63 |
| | 127 | 127 | 127 | 127 | 127 | 127 | 127 | 127 | 127 | 127 |
| | 191 | 191 | 191 | 191 | 191 | 191 | 191 | 191 | 191 | 191 |
| | 223 | 223 | 223 | 223 | 223 | 223 | 223 | 223 | 223 | 223 |
| | 254 | 254 | 254 | 254 | 254 | 254 | 254 | 254 | 254 | 254 |
| | 255 | 255 | 255 | 255 | 255 | 255 | 255 | 255 | 255 | 255 |

FIG. 6

| | | Initial gray-scale | | | | | | | | |
|---|---|---|---|---|---|---|---|---|---|---|
| | | 0 | 1 | 31 | 63 | 127 | 191 | 223 | 254 | 255 |
| Target gray-scale | 0 | | | | | | | | | |
| | 1 | | | | | | | | | |
| | 31 | | | | | | | | | |
| | 63 | | | | | | | | | |
| | 127 | | | | | | | | | |
| | 191 | | | | 199 | | | | | |
| | 223 | | | | | | | | | |
| | 254 | | | | | | | | | |
| | 255 | | | | | | | | | |

FIG. 7

DEVICE FOR GENERATING GRAY-SCALE DRIVE TABLE AND METHOD THEREOF, DISPLAY PANEL AND METHOD FOR DRIVING THE SAME

CROSS-REFERENCE OF RELATED APPLICATIONS

The present disclosure is a 35 U.S.C. § 371 national phase application of International Application No. PCT/CN2020/070754, filed on Jan. 7, 2020, which is based upon and claims priority to Chinese Patent Application No. 201910031692.9, filed on Jan. 14, 2019, the contents of which are incorporated by reference in their entireties herein.

TECHNICAL FIELD

The present disclosure relates to display technology and, more particularly, to a device for generating a gray-scale drive table and a method for generating a gray-scale drive table, a display panel, and a method for driving the display panel.

BACKGROUND

When driving a sub-pixel unit, a liquid crystal display panel needs to determine a drive gray-scale of the sub-pixel unit according to an initial gray-scale and a target gray-scale of the sub-pixel unit. In the relevant technology, a gray-scale drive table is usually established first, which contains every initial gray-scales, target gray-scales, and corresponding drive gray-scales of the sub-pixel unit. When driving, the liquid crystal display panel is only necessary to drive the respective sub-pixel units according to the gray-scale drive table.

In the relevant technology, the liquid crystal display panel is usually driven in the form of voltage polarity inversion, such as dot inversion, row inversion, column inversion, frame inversion, etc. Since a drive voltage of a sub-pixel of a positive-frame (a pixel driven by voltage with positive polarity) is different from that of a sub-pixel of a negative-frame (a pixel driven by voltage with negative polarity) and the charging current of the sub-pixel of the positive-frame is different from that of the sub-pixel of the negative-frame, there is a difference between the charging voltage of the sub-pixel of the positive-frame and the charging voltage of the sub-pixel of the negative-frame within charging time of one frame, thus causing display unevenness and afterimages.

It should be noted that information disclosed in this section are provided only for acquiring a better understanding of the background of the present application and therefore it may include information of current technology that is not already known to those of ordinary skill in the art.

SUMMARY

It is an objective of the present disclosure to provide a device for generating a gray-scale drive table and a method for generating a gray-scale drive table, a display panel, and a method for driving the display panel to at least partially improve the afterimage and display unevenness.

According to an aspect of the present disclosure, there is provided a gray-scale drive table generating device, including: a sampling circuit, configured to collect a first voltage between a drive electrode of a sub-pixel of a positive-frame and a common electrode as well as a second voltage between a drive electrode of a sub-pixel of a negative-frame and the common electrode in a display panel in each gray-scale; a processing circuit, connected to the sampling circuit and configured to generate a trigger signal when a voltage difference between the first voltage and the second voltage is greater than a voltage threshold; an adjustment circuit, connected to the processing circuit and configured to adjust drive gray-scales of the sub-pixel of the positive-frame and/or the sub-pixel of the negative-frame in response to the trigger signal, to make the voltage difference less than the voltage threshold; and a recording circuit, configured to generate an adjusted gray-scale drive table according to the drive gray-scales of the sub-pixel of the positive-frame and the sub-pixel of the negative-frame in the gray-scale.

In an exemplary embodiment of the present disclosure, the adjusted gray-scale drive table includes a first gray-scale drive table for driving the sub-pixel of the positive-frame and a second gray-scale drive table for driving the sub-pixel of the negative-frame.

In an exemplary embodiment of the present disclosure, the sampling circuit includes: a first subtraction circuit, having a first input terminal being connected to the drive electrode of the sub-pixel of the positive-frame and a second input terminal being connected to the common electrode; and a second subtraction circuit, having a first input terminal being connected to the common electrode and a second input terminal being connected to the drive electrode of the sub-pixel of the negative-frame.

In an exemplary embodiment of the present disclosure, the processing circuit includes: a third subtraction circuit, having a first input terminal being connected to an output terminal of the second subtraction circuit and a second input terminal being connected to an output terminal of the first subtraction circuit; and an OR gate, having a first input terminal being connected to an output terminal of the three subtraction circuit, a second input terminal being connected to a ground terminal, and an output terminal being connected to the adjustment circuit, wherein a reference voltage of the OR gate is the voltage threshold, and a voltage of the ground terminal is less than the voltage threshold.

In an exemplary embodiment of the present disclosure, the first subtraction circuit is connected to the drive electrode of the sub-pixel of the positive-frame through a first lead, and is connected to the common electrode through a second lead; and the second subtraction circuit is connected to the drive electrode of the sub-pixel of the negative-frame through a third lead, and is connected to the common electrode through a fourth lead; and the first lead has a same resistance as that of the second lead, and the third lead has a same resistance as that of the fourth lead.

In an exemplary embodiment of the present disclosure, the adjustment circuit is configured to: gradually increase the drive gray-scale of the sub-pixel of the positive-frame according to a first gray-scale interval in response to the trigger signal; or gradually decrease the drive gray-scale of the sub-pixel of the negative-frame according to the first gray-scale interval in response to the trigger signal; or gradually increase the drive gray-scale of the sub-pixel of the positive-frame according to the first gray-scale interval and meanwhile gradually decrease the drive gray-scale of the sub-pixel of the negative-frame according to the first gray-scale interval in response to the trigger signal; or gradually decrease the drive gray-scale of the sub-pixel of the negative-frame according to a second gray-scale interval different from the first gray-scale interval in response to the trigger signal; or gradually increase the drive gray-scale of the sub-pixel of the positive-frame according to the first gray-scale interval and meanwhile gradually decrease the drive gray-scale of the sub-pixel of the negative-frame according to the second gray-scale interval in response to the trigger signal, so as to make the voltage difference less than the voltage threshold.

According to an aspect of the present disclosure, there is provided a display panel, including: the above gray-scale drive table generating device; and a screen driver board, connected to the gray-scale drive table generating device, and configured to drive the sub-pixel of the positive-frame and the sub-pixel of the negative-frame according to the gray-scale drive table.

In an exemplary embodiment of the present disclosure, the sampling circuit includes: a first subtraction circuit having a first input terminal being connected to the drive electrode of the sub-pixel of the positive-frame and a second input terminal being connected to the common electrode; and a second subtraction circuit having a first input terminal being connected to the common electrode and a second input terminal being connected to the drive electrode of the sub-pixel of the negative-frame.

In an exemplary embodiment of the present disclosure, the first subtraction circuit is connected to the drive electrode of the sub-pixel of the positive-frame through a first lead, and is connected to the common electrode through a second lead; and the second subtraction circuit is connected to the drive electrode of the sub-pixel of the negative-frame through a third lead, and is connected to the common electrode through a fourth lead; and the first lead has a same resistance as that of the second lead, and the third lead has a same resistance as that of the fourth lead.

In an exemplary embodiment of the present disclosure, the display panel further includes a chip-on-film, provided with a source driver chip; and a printed circuit board, connected between the chip-on-film and the screen driver board; and the first lead, the second lead, the third lead and the fourth lead are integrated on the chip-on-film and the printed circuit board.

According to an aspect of the present disclosure, there is provided a method for generating a gray-scale drive table, including: collecting a first voltage between a drive electrode of a sub-pixel of a positive-frame and a common electrode as well as a second voltage between a drive electrode of a sub-pixel of a negative-frame and the common electrode in a display panel in each gray-scale; generating a trigger signal when a voltage difference between the first voltage and the second voltage is greater than a voltage threshold;

adjusting drive gray-scales of the sub-pixel of the positive-frame and/or the sub-pixel of the negative-frame in response to the trigger signal, so as to make the voltage difference less than the voltage threshold; and generating an adjusted gray-scale drive table according to the drive gray-scales of the sub-pixel of the positive-frame and the sub-pixel of the negative-frame in the gray-scale.

In an exemplary embodiment of the present disclosure, the gray-scale drive table includes a first gray-scale drive table for driving the sub-pixel of the positive-frame and a second gray-scale drive table for driving the sub-pixel of the negative-frame.

In an exemplary embodiment of the present disclosure, adjusting drive gray-scales of the sub-pixel of the positive-frame and/or the sub-pixel of the negative-frame in response to the trigger signal, so as to make the voltage difference less than the voltage threshold includes: gradually increasing the drive gray-scale of the sub-pixel of the positive-frame according to a first gray-scale interval in response to the trigger signal.

In an exemplary embodiment of the present disclosure, adjusting drive gray-scales of the sub-pixel of the positive-frame and/or the sub-pixel of the negative-frame in response to the trigger signal, so as to make the voltage difference less than the voltage threshold includes: gradually decreasing the drive gray-scale of the sub-pixel of the negative-frame according to a second gray-scale interval in response to the trigger signal.

In an exemplary embodiment of the present disclosure, adjusting drive gray-scales of the sub-pixel of the positive-frame and/or the sub-pixel of the negative-frame in response to the trigger signal, so as to make the voltage difference less than the voltage threshold includes: gradually decreasing the drive gray-scale of the sub-pixel of the negative-frame according to a first gray-scale interval in response to the trigger signal; or gradually decreasing the drive gray-scale of the sub-pixel of the negative-frame according to a second gray-scale interval different from the first gray-scale interval in response to the trigger signal.

According to an aspect of the present disclosure, there is provided a method for driving a display panel, applied to the above display panel, including: driving the sub-pixel of the positive-frame according to the first gray-scale drive table; and driving the sub-pixel of the negative-frame according to the second gray-scale drive table.

The present disclosure provides a device for generating a gray-scale drive table and a method for generating a gray-scale drive table, a display panel, and a method for driving the display panel. The device for generating a gray-scale drive table eliminates the difference between the first voltage and the second voltage by adjusting the drive gray-scales of the sub-pixel of the positive-frame and/or the sub-pixel of the negative-frame through the sampling unit, the processing unit and the adjustment unit, and records the drive gray-scales of the sub-pixel of the positive-frame and the sub-pixel of the negative-frame in drive modes of the respective gray-scales, to generate the adjusted gray-scale drive table. On one hand, the adjusted gray-scale drive table generated by the gray-scale drive table generating device provided by the present disclosure can improve the afterimage and uneven display of the display panel. On the other hand, the gray-scale drive table generating device has a simple structure and low cost of production.

It is to be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated in and constitute part of this specification, illustrate embodiments consistent with the disclosure and, together with the description, serve to explain the principles of the disclosure. Understandably, the drawings in the following description are only some embodiments of the present disclosure, and those skilled in the art can further obtain other drawings based on these drawings without any creative work.

FIG. 6 is a schematic diagram of a normal gray-scale drive table;

FIG. 7 is a schematic diagram of a gray-scale drive table of a positive-frame generated by a method for generating a gray-scale drive table according to the present disclosure.

DETAILED DESCRIPTION

Figure 1:
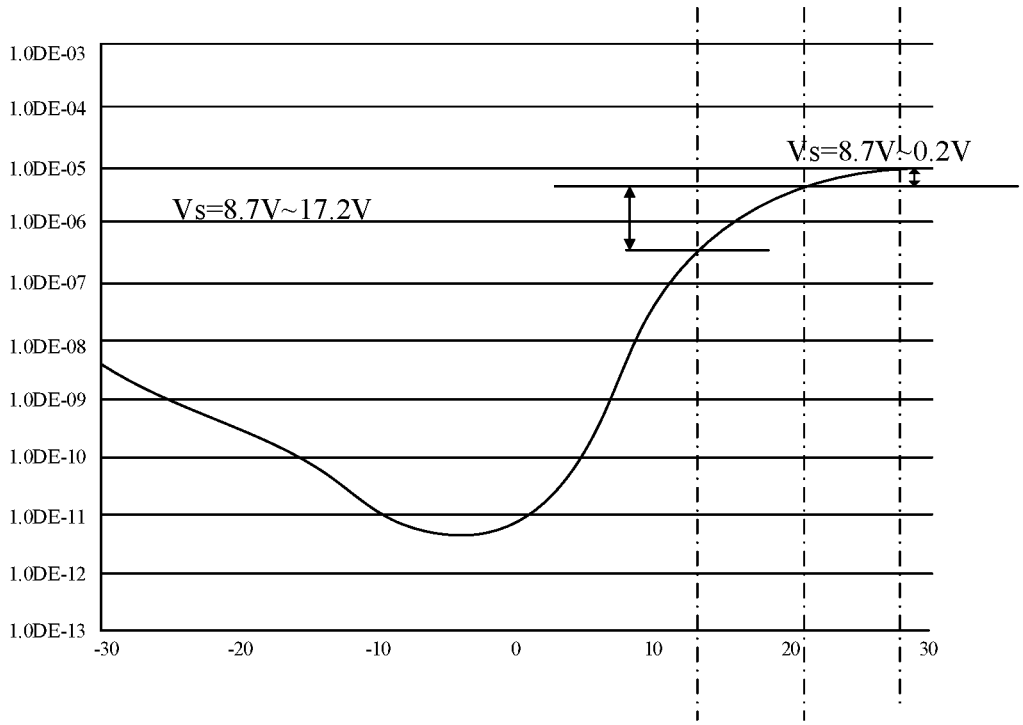
FIG. 1 is a diagram showing the relationship between a source gate voltage and an output current of a drive transistor in a sub-pixel drive circuit according to an exemplary embodiment of the relevant technology.

Exemplary embodiments will now be described more fully by reference to the accompanying drawings. However, the exemplary embodiments can be implemented in various forms and should not be understood as being limited to the examples set forth herein; rather, the embodiments are provided so that this disclosure will be thorough and complete, and the conception of exemplary embodiments will be fully conveyed to those skilled in the art. The same reference signs in the drawings denote the same or similar structures and detailed description thereof will be omitted.

Although terms having opposite meanings such as "above" and "under" are used herein to describe the relationship of one component relative to another component, such terms are used herein only for the sake of convenience, for example, "in the direction illustrated in the figure." It can be understood that if a device denoted in the drawings is turned upside down, a component described as "above" something will become a component described as "under" something. Other terms having opposite meanings such as "high", "low", "top", "bottom", "left", "right" also have similar meanings. When a structure is described as "above" another structure, it probably means that the structure is integrally formed on another structure, or, the structure is "directly" disposed on another structure, or, the structure is "indirectly" disposed on another structure through an additional structure.

Words such as "one", "an/a", and "the" are used herein to indicate the presence of one or more elements, component parts, and others. Terms "including" and "having" have an inclusive meaning which means that there may be additional elements, component parts, and others in addition to the listed elements, component parts, and others.

In the relevant technology, before a liquid crystal display panel is driven, a gray-scale drive table is usually established first. The gray-scale drive table includes every initial gray-scales, target gray-scales and corresponding drive gray-scales of the sub-pixel unit. During driving, the liquid crystal display panel is only necessary to drive the respective sub-pixel units according to the gray-scale drive table. The gray-scale drive table may be either an over drive gray-scale drive table (i.e., over drive table), or a normal gray-scale drive table (that is, the drive gray-scale is equal to the target gray-scale), or any other type of gray-scale drive table. In the relevant technology, the liquid crystal display panel is usually driven in the form of voltage polarity inversion, such as dot inversion, row inversion, column inversion, frame inversion. FIG. 1 is a diagram showing the relationship between a source gate voltage and an output current of a drive transistor in a sub-pixel drive circuit according to an exemplary embodiment of the relevant technology. Under the same drive gray-scale, since a drive voltage of the sub-pixel of the positive-frame is different from that of the sub-pixel of the negative-frame, the charging current of the sub-pixel of the positive-frame is less than that of the sub-pixel of the negative-frame. The voltage of the sub-pixel of the positive-frame after charging is lower than the voltage of the sub-pixel of the negative-frame after charging within charging time of one frame, which leads to uneven display and afterimage.

Figure 2:
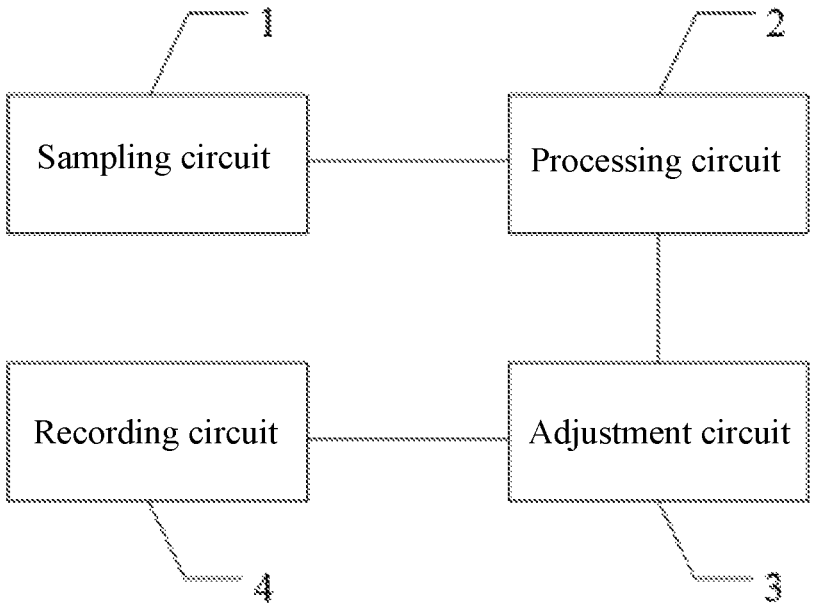
FIG. 2 is a schematic structural diagram of a gray-scale drive table generating device according to an exemplary embodiment of the present disclosure.

The exemplary embodiment first provides a gray-scale drive table generating device. FIG. 2 is a schematic structural diagram of a gray-scale drive table generating device according to an exemplary embodiment of the present disclosure. The device includes a sampling circuit 1, a processing circuit 2, an adjustment circuit 3 and a recording circuit 4. The sampling circuit 1 is configured to collect a first voltage between a drive electrode of a sub-pixel of a positive-frame and a common electrode as well as a second voltage between a drive electrode of a sub-pixel of a negative-frame and the common electrode in a display panel in each gray-scale. The processing circuit 2 is connected to the sampling circuit 1 and is configured to generate a trigger signal when a voltage difference between the first voltage and the second voltage is greater than a voltage threshold. The adjustment circuit 3 is connected to the processing circuit 2 and is configured to adjust drive gray-scales of the sub-pixel of the positive-frame and/or the sub-pixel of the negative-frame in response to the trigger signal, to make the voltage difference less than the voltage threshold. The recording circuit 4 is configured to generate an adjusted gray-scale drive table according to the drive gray-scales of the sub-pixel of the positive-frame and the sub-pixel of the negative-frame in each gray-scale.

In the exemplary embodiment, the display panel may be in a display mode such as dot inversion, column inversion, and row inversion, etc. A sub-pixel unit of the positive-frame and a sub-pixel unit of the negative-frame may be any two sub-pixels with opposite drive voltage directions within the same frame time on the display panel. The display of each gray-scale may be realized by driving a sub-pixel unit from an initial gray-scale to a target gray-scale through a source drive circuit of the display panel according to an initial gray-scale drive table. The initial gray-scale drive table may be either an over drive gray-scale drive table (i.e., over drive table), or a normal gray-scale drive table (that is, the drive gray-scale is equal to the target gray-scale), or any other type of gray-scale drive table. It should be understood that, in other exemplary embodiments, the display panel may also be in a frame inversion drive mode, and the sub-pixel of the positive-frame and the sub-pixel of the negative-frame may be sub-pixels with opposite drive voltage directions on two adjacent frames.

The exemplary embodiment provides a device for generating a gray-scale drive table, which eliminates the difference between the first voltage and the second voltage by adjusting the drive gray-scales of the sub-pixel of the positive-frame and/or the sub-pixel of the negative-frame through the sampling unit, the processing unit and the adjustment unit, and records the drive gray-scales of the sub-pixel of the positive-frame and the sub-pixel of the negative-frame in drive modes of the respective gray-scales, to generate the adjusted gray-scale drive table. On one hand, the adjusted gray-scale drive table generated by the gray-scale drive table generating device provided by the present disclosure can improve the afterimage and uneven display of the display panel; on the other hand, the gray-scale drive table generating device has a simple structure and low cost of production. Other embodiments of the disclosure will be apparent to those skilled in the art from consideration of the specification and practice of the disclosure disclosed here.

In the exemplary embodiment, the gray-scale drive table includes a first gray-scale drive table for driving the sub-pixel of the positive-frame and a second gray-scale drive table for driving the sub-pixel of the negative-frame. Based on the above description of the relevant technology, under the same drive gray-scale, a charging voltage of the sub-pixel of the positive-frame is less than that of the sub-pixel of the negative-frame within one frame time. Therefore, the above-mentioned initial gray-scale drive table with its drive gray-scales being increased may be used as the first gray-scale drive table and the initial gray-scale table is used as the second gray-scale drive table; or the above-mentioned initial gray-scale drive table with its drive gray-scales being decreased may be used as the second gray-scale drive table and the initial gray-scale table is used as the first gray-scale drive table; or the above-mentioned initial gray-scale drive table with its drive gray-scales being increased may be used as the first gray-scale drive table and the above-mentioned initial gray-scale drive table with its drive gray-scales being decreased may be used as the second gray-scale drive table.

Figure 3:
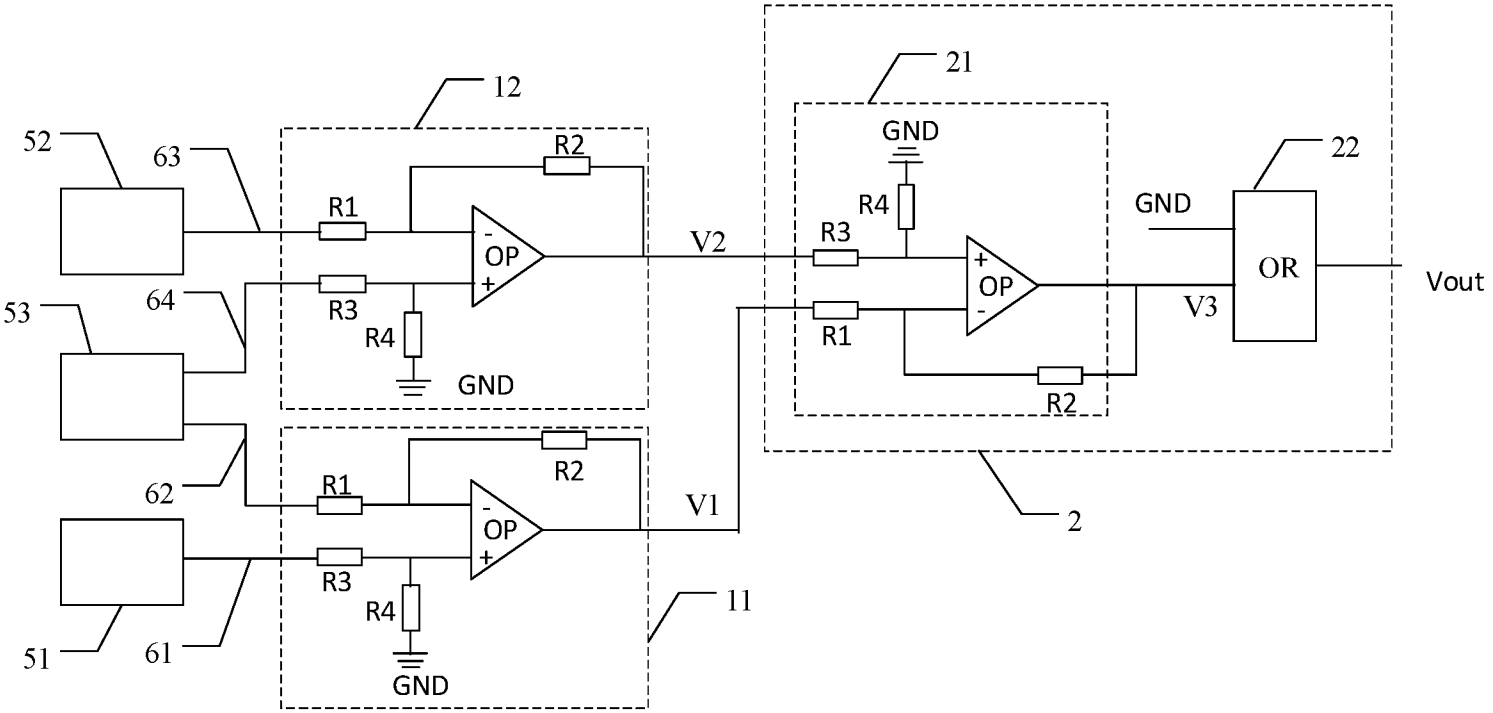
FIG. 3 is a schematic structural diagram of a portion of a circuit of a gray-scale drive table generating device according to an exemplary embodiment of the present disclosure.

In an exemplary embodiment, FIG. 3 is a schematic structural diagram of a portion of a circuit of a gray-scale drive table generating device according to an exemplary embodiment of the present disclosure. The sampling circuit 1 may include a first subtraction circuit 11 and a second subtraction circuit 12. A first input terminal of the first subtraction circuit 11 is connected to a drive electrode 51 of the sub-pixel of the positive-frame and a second input terminal of the first subtraction circuit 11 is connected to a common electrode 53. A first input terminal of the second subtraction circuit 12 is connected to the common electrode 53 and a second input terminal of the second subtraction circuit 12 is connected to a drive electrode 52 of the sub-pixel of the negative-frame. The first subtraction circuit outputs a first voltage ΔV1 between the drive electrode of the sub-pixel of the positive-frame and the common electrode. The second subtraction circuit outputs a second voltage ΔV2 between the drive electrode of the sub-pixel of the negative-frame and the common electrode. The subtraction circuit 11 may include an operational amplifier OP, a first resistor R1, a second resistor R2, a third resistor R3 and a fourth resistor R4. A terminal of the first resistor R1 is connected to an inverting input terminal of the operational amplifier OP and a second terminal of the first resistor R1 forms the second input terminal of the subtraction circuit. A first terminal of the second resistor R2 is connected to the inverting input terminal of the operational amplifier OP and a second terminal of the second resistor R2 is connected to an output terminal of the operational amplifier OP. A first terminal of the third resistor R3 is connected to a non-inverting input terminal of the operational amplifier OP and a second terminal of the third resistor R3 forms the first input terminal of the subtraction circuit. A first terminal of the fourth resistor R4 is connected to the non-inverting input terminal of the operational amplifier OP and a second terminal of the fourth resistor R4 is grounded. As an exemplary example, R1=R2=R3=R4. It should be understood that, in other exemplary embodiments, the subtraction circuit may have more alternative structures, all of which fall within the protection scope of the present disclosure. In the exemplary embodiment, the second subtraction circuit may have the same circuit structure as that of the first subtraction circuit. It should be understood that, in other exemplary embodiments, the second subtraction circuit may be other circuit structures.

In the exemplary embodiment, as shown in FIG. 3, the processing circuit 2 may include a third subtraction circuit 21 and an OR gate 22. A first input terminal of the third subtraction circuit 21 is connected to an output terminal of the second subtraction circuit, and a second input terminal of the third subtraction circuit 21 is connected to an output terminal of the first subtraction circuit. A first input terminal of the OR gate 22 is connected to an output terminal of the three subtraction circuit, a second input terminal of the OR gate 22 is connected to a ground terminal, and an output terminal of the OR gate 22 is connected to the adjustment circuit 3. The OR gate 22 is provided with a reference voltage, for example, the reference voltage of the OR gate 22 may be the voltage threshold. The voltage of the ground terminal may be less than the voltage threshold. For example, the third subtraction circuit may have the same structure as that of the first subtraction circuit. The output terminal of the third subtraction circuit outputs a voltage difference ΔV3 between the second voltage ΔV2 and the first voltage ΔV1, i.e., ΔV3=ΔV2−ΔV1. For example, when voltage at an input terminal of the OR gate 22 is less than the reference voltage, the OR gate 22 determines that the input terminal is logic 0; and when voltage at an input terminal of the OR gate 22 is greater than the reference voltage, the OR gate 22 determines that the input terminal is logic 1. The reference voltage is the voltage threshold. That is, when the voltage difference ΔV3 between the second voltage ΔV2 and the first voltage ΔV1 is greater than the voltage threshold, the OR gate 22 outputs logic 0; and when the voltage difference ΔV3 between the second voltage ΔV2 and the first voltage ΔV1 is less than the voltage threshold, the OR gate 22 outputs logic 1. The logic 0 can be the above-described trigger signal. It should be understood that, in other exemplary embodiments, the third subtraction circuit may have more alternative structures.

Figure 4:
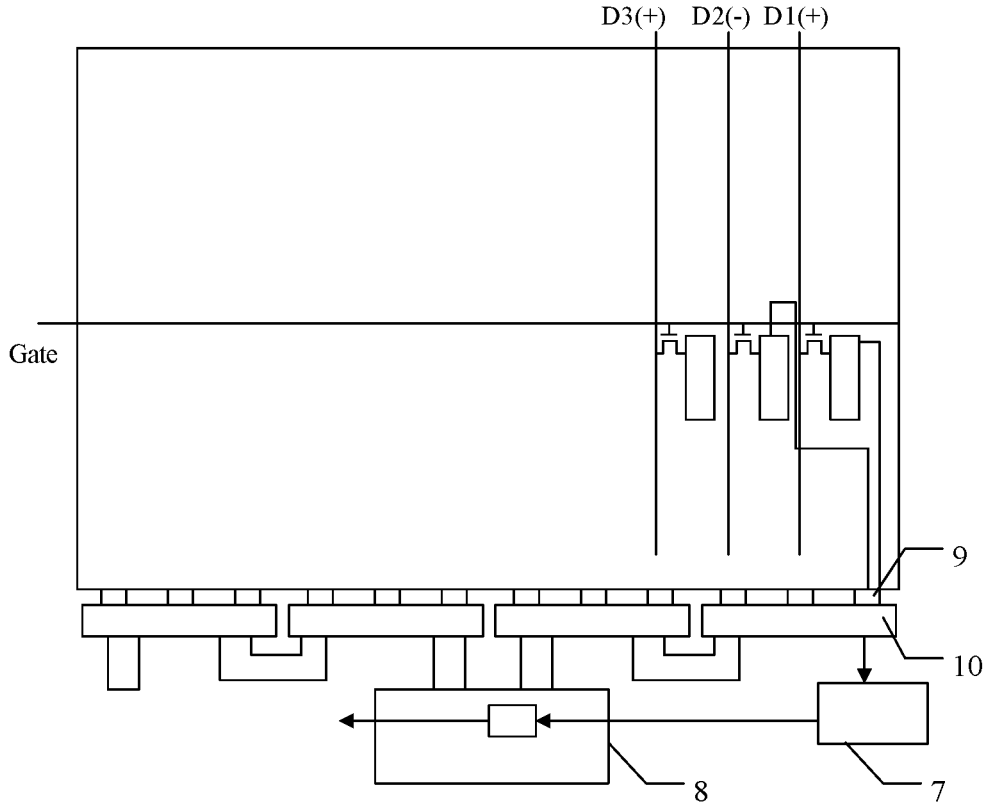
FIG. 4 is a schematic structural diagram of a display panel according to an exemplary embodiment of the present disclosure.

The exemplary embodiment further provides a display panel. FIG. 4 is a schematic structural diagram of a display panel according to an exemplary embodiment of the present disclosure. The display panel includes the above-mentioned gray-scale drive table generating device 7 and a screen driver board (TCON) 8. The screen driver board is connected to the gray-scale drive table generating device, and is configured to drive the sub-pixel of the positive-frame and the sub-pixel of the negative-frame according to the gray-scale drive table. The adjustment circuit 3 and the recording circuit 4 may be integrated on the screen driver board 8, and the adjustment circuit 3 may be directly realized by the screen driver board 8 as well. It should be noted that FIG. 4 shows a display panel in a column inversion drive mode. It should be understood that the display panel provided by the exemplary embodiment may also be in the form of other inversions, such as frame inversion, row inversion, etc.

In the exemplary embodiment, as shown in FIG. 3, the first subtraction circuit 11 is connected to the drive electrode 51 of the sub-pixel of the positive-frame through a first lead 61 and is connected to the common electrode 53 through a second lead 62. The second subtraction circuit 12 is connected to the drive electrode 52 of the sub-pixel of the negative-frame through a third lead 63 and is connected to the common electrode 53 through a fourth lead 64. The first lead has the same resistance as that of the second lead and the third lead has the same resistance as that of the fourth lead, so as to avoid that the attenuation differences of the voltages on the leads influence on the collection accuracy of the first voltage and the second voltage.

In the exemplary embodiment, as shown in FIG. 4, the display panel further includes: a chip-on-film 9, which is provided with a source driver chip, and a printed circuit board 10 connected between the chip-on-film 9 and the screen driver board 8. The first lead, the second lead, the third lead and the fourth lead may be integrated on the chip-on-film 9 and the printed circuit board 10.

The display panel provided by the exemplary embodiment has the same technical features and working principle as those of the above-mentioned gray-scale drive table generating device. The foregoing contents have been described in detail and thus will not be elaborated here.

Figure 5:
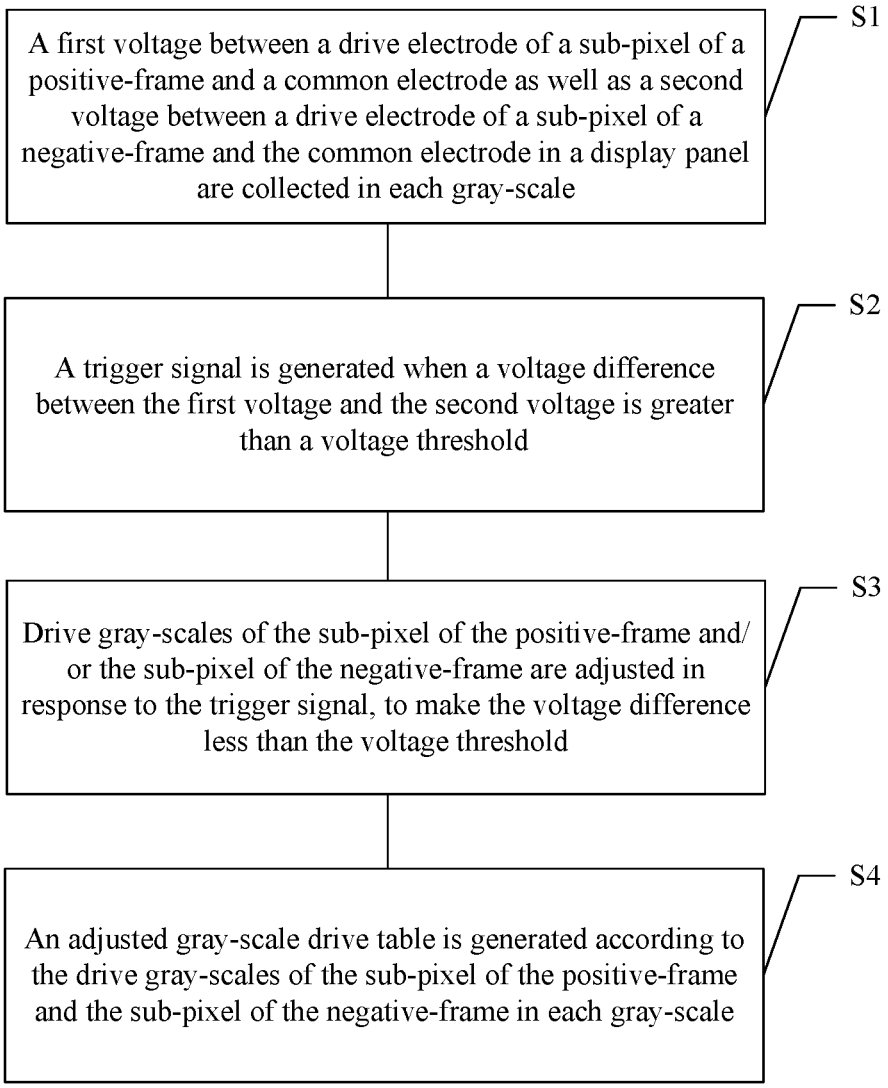
FIG. 5 is a flowchart of a method for generating a gray-scale drive table according to an exemplary embodiment of the present disclosure.

The present exemplary embodiment further provides a method for generating a gray-scale drive table, which is applied to the above-mentioned gray-scale drive table generating device. FIG. 5 is a flowchart of a method for generating a gray-scale drive table according to an exemplary embodiment of the present disclosure. The method includes the following steps:

In step S1, a first voltage between a drive electrode of a sub-pixel of a positive-frame and a common electrode as well as a second voltage between a drive electrode of a sub-pixel of a negative-frame and the common electrode in a display panel are collected in each gray-scale.

In step S2, a trigger signal is generated when a voltage difference between the first voltage and the second voltage is greater than a voltage threshold.

In step S3, drive gray-scales of the sub-pixel of the positive-frame and/or the sub-pixel of the negative-frame are adjusted in response to the trigger signal, to make the voltage difference less than the voltage threshold.

In step S4, an adjusted gray-scale drive table is generated according to the drive gray-scales of the sub-pixel of the positive-frame and the sub-pixel of the negative-frame in each gray-scale.

In the exemplary embodiment, the gray-scale drive table includes a first gray-scale drive table for driving the sub-pixel of the positive-frame and a second gray-scale drive table for driving the sub-pixel of the negative-frame. Based on the above description of the relevant technology, under the same drive gray-scale, the charging voltage of the sub-pixel of the positive-frame is less than that of the sub-pixel of the negative-frame within one frame time. In the present disclosure, the above-mentioned initial gray-scale drive table with its drive gray-scales being increased may be used as the first gray-scale drive table and the initial gray-scale table is used as the second gray-scale drive table; or the above-mentioned initial gray-scale drive table with its drive gray-scales being decreased may be used as the second gray-scale drive table and the initial gray-scale table is used as the first gray-scale drive table; or the above-mentioned initial gray-scale drive table with its drive gray-scales being increased may be used as the first gray-scale drive table and the above-mentioned initial gray-scale drive table with its drive gray-scales being decreased may be used as the second gray-scale drive table.

In the exemplary embodiment, adjusting the drive gray-scales of the sub-pixel of the positive-frame and/or the sub-pixel of the negative-frame in response to the trigger signal, to make the voltage difference between the first voltage and the second voltage less than the voltage threshold, may include: gradually increasing the drive gray-scales of the sub-pixel of the positive-frame according to a first gray-scale interval in response to the trigger signal. In the exemplary embodiment, the initial gray-scale drive table may be a normal gray-scale drive table, for example, FIG. 6 is a schematic diagram of a normal gray-scale drive table, and a part of a normal gray-scale table is shown in FIG. 6. The first gray-scale interval may be 1. The exemplary embodiment will be described by taking a drive mode from an initial gray-scale 63 to a target gray-scale 191 as an example. According to the normal gray-scale drive table, in the drive mode, the drive gray-scales of both the sub-pixel of the positive-frame and the sub-pixel of the negative-frame are 191. When the voltage difference between the first voltage and the second voltage is greater than a voltage threshold, such that a trigger signal is generated, the drive gray-scale of the sub-pixel of the positive-frame may be gradually increased according to the first gray-scale interval in response to the trigger signal. For example, the drive gray-scale of the sub-pixel of the positive-frame is changed into 192 and the drive gray-scale of the sub-pixel of the negative-frame is still 191, and the voltage difference between the first voltage and the second voltage is re-determined in the above-mentioned gray-scale until the voltage difference between the first voltage and the second voltage is less than the voltage threshold. For example, if it is determined that the voltage difference between the first voltage and the second voltage is less than the voltage threshold when the drive gray-scale of the sub-pixel of the positive-frame is 199, then 199 is recorded as the drive gray-scale of the sub-pixel unit of the positive-frame in the above-mentioned gray-scale. The drive gray-scales of the sub-pixel of the positive-frame in different gray-scales are checked, thereby generating the first gray-scale drive table of the sub-pixel of the positive-frame. FIG. 7 is a schematic diagram of a gray-scale drive table of a positive-frame generated by a method for generating a gray-scale drive table according to the present disclosure. The normal gray-scale drive table may be used as the second gray-scale drive table of the sub-pixel of the negative-frame. It should be understood that, in other exemplary embodiments, the first gray-scale interval may further be other figures, such as 2, 3, etc., and the smaller the first gray-scale interval is, the more accurate the first gray-scale drive table will be. There may be other implementation manners for adjusting the drive gray-scales of the sub-pixel of the positive-frame and/or the sub-pixel of the negative-frame in response to the trigger signal, to make the voltage difference less than the voltage threshold. For example, the drive gray-scale of the sub-pixel of the negative-frame is gradually decreased according to a second gray-scale interval in response to the trigger signal; or, the drive gray-scale of the sub-pixel of the negative-frame is gradually decreased according to the second gray-scale interval in response to the trigger signal and meanwhile the drive gray-scale of the sub-pixel of the positive-frame may be gradually increased according to the first gray-scale interval in response to the trigger signal. The second gray-scale interval may be or may be not equal to the first gray-scale interval. The initial gray-scale drive table may be an over drive gray-scale drive table or other gray-scale drive tables as well.

Figure 8:
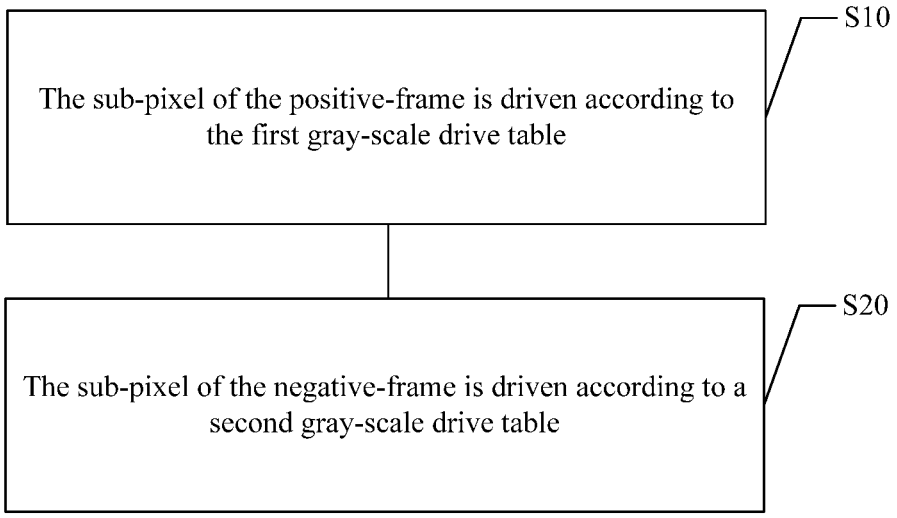
FIG. 8 is a flowchart of a method for driving a display panel according to an exemplary embodiment of the present disclosure.

The present exemplary embodiment further provides a method for driving a display panel, which is applied to the above-described display panel. FIG. 8 is a flowchart of a method for driving a display panel according to an exemplary embodiment of the present disclosure. The method includes the following steps:

In step S10, the sub-pixel of the positive-frame is driven according to the first gray-scale drive table.

In step S20, the sub-pixel of the negative-frame is driven according to a second gray-scale drive table, wherein the first gray-scale drive table and the second gray-scale drive table are generated according to the method for generating a gray-scale drive table according to the present disclosure as shown in FIG. 5.

The method for driving a display panel provided by the exemplary embodiment has the same technical features and working principle as those of the above-mentioned display panel, which have been described in detail by the foregoing contents and thus will not be elaborated here.

This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

The above-described features, structures or characteristics may be combined in one or more embodiments in any appropriate way. Wherever possible, features discussed in each embodiment are interchangeable. In the foregoing description, many specific details are provided for fully understanding embodiments of the present disclosure. However, it will be appreciated by those skilled in the art that technical solutions of the present disclosure can be practiced without one or more of the specific details or, other methods, components, and materials may be used. Under other circumstances, well-known structures, materials, or operations will not be illustrated or described in detail, to avoid obscuration of various aspects of the present disclosure.

What is claimed is:

1. A gray-scale drive table generating device, comprising:

a sampling circuit configured to collect a first voltage between a drive electrode of a sub-pixel of a positive-frame and a common electrode as well as a second voltage between a drive electrode of a sub-pixel of a negative-frame and the common electrode in a display panel in each gray-scale;

a processing circuit connected to the sampling circuit and configured to generate a trigger signal when a voltage difference between the first voltage and the second voltage is greater than a voltage threshold;

an adjustment circuit connected to the processing circuit and configured to adjust drive gray-scales of the sub-pixel of the positive-frame or the sub-pixel of the negative-frame in response to the trigger signal to make the voltage difference less than the voltage threshold; and a recording circuit configured to generate an adjusted gray-scale drive table according to the drive gray-scales of the sub-pixel of the positive-frame and the sub-pixel of the negative-frame in the gray-scale.

2. The gray-scale drive table generating device according to claim 1, wherein the adjusted gray-scale drive table comprises a first gray-scale drive table for driving the sub-pixel of the positive-frame and a second gray-scale drive table for driving the sub-pixel of the negative-frame.

3. The gray-scale drive table generating device according to claim 1, wherein the sampling circuit comprises:

a first subtraction circuit having a first input terminal being connected to the drive electrode of the sub-pixel of the positive-frame and a second input terminal being connected to the common electrode; and a second subtraction circuit having a first input terminal being connected to the common electrode and a second input terminal being connected to the drive electrode of the sub-pixel of the negative-frame.

4. The gray-scale drive table generating device according to claim 3, wherein the processing circuit comprises:

a third subtraction circuit having a first input terminal being connected to an output terminal of the second subtraction circuit and a second input terminal being connected to an output terminal of the first subtraction circuit; and an OR gate having a first input terminal being connected to an output terminal of the three subtraction circuit, a second input terminal being connected to a ground terminal, and an output terminal being connected to the adjustment circuit, wherein a reference voltage of the OR gate is the voltage threshold, and a voltage of the ground terminal is less than the voltage threshold.

5. The gray-scale drive table generating device according to claim 3, wherein:

the first subtraction circuit is connected to the drive electrode of the sub-pixel of the positive-frame through a first lead, and is connected to the common electrode through a second lead; and the second subtraction circuit is connected to the drive electrode of the sub-pixel of the negative-frame through a third lead, and is connected to the common electrode through a fourth lead; and the first lead has a same resistance as that of the second lead, and the third lead has a same resistance as that of the fourth lead.

6. The gray-scale drive table generating device according to claim 1, wherein the adjustment circuit is configured to:

gradually increase the drive gray-scale of the sub-pixel of the positive-frame according to a first gray-scale interval in response to the trigger signal;

gradually decrease the drive gray-scale of the sub-pixel of the negative-frame according to the first gray-scale interval in response to the trigger signal;

gradually increase the drive gray-scale of the sub-pixel of the positive-frame according to the first gray-scale interval and meanwhile gradually decrease the drive gray-scale of the sub-pixel of the negative-frame according to the first gray-scale interval in response to the trigger signal;

gradually decrease the drive gray-scale of the sub-pixel of the negative-frame according to a second gray-scale interval different from the first gray-scale interval in response to the trigger signal; or gradually increase the drive gray-scale of the sub-pixel of the positive-frame according to the first gray-scale interval and meanwhile gradually decrease the drive gray-scale of the sub-pixel of the negative-frame according to the second gray-scale interval in response to the trigger signal, so as to make the voltage difference less than the voltage threshold.

7. The gray-scale drive table generating device according to claim 1, wherein the gray-scale drive table generating device is implemented in a display panel that comprises a screen driver board connected to the gray-scale drive table generating device, and configured to drive the sub-pixel of the positive-frame and the sub-pixel of the negative-frame according to the gray-scale drive table.

8. The gray-scale drive table generating device according to claim 7, wherein the sampling circuit comprises:

a first subtraction circuit having a first input terminal being connected to the drive electrode of the sub-pixel of the positive-frame and a second input terminal being connected to the common electrode; and a second subtraction circuit having a first input terminal being connected to the common electrode and a second input terminal being connected to the drive electrode of the sub-pixel of the negative-frame.

9. The gray-scale drive table generating device according to claim 8, wherein:

the first subtraction circuit is connected to the drive electrode of the sub-pixel of the positive-frame through a first lead, and is connected to the common electrode through a second lead;

the second subtraction circuit is connected to the drive electrode of the sub-pixel of the negative-frame through a third lead, and is connected to the common electrode through a fourth lead; and the first lead has a same resistance as that of the second lead, and the third lead has a same resistance as that of the fourth lead.

10. The gray-scale drive table generating device according to claim 9, wherein the display panel further comprises a chip-on-film provided with a source driver chip; a printed circuit board connected between the chip-on-film and the screen driver board; and the first lead, the second lead, the third lead and the fourth lead are integrated on the chip-on-film and the printed circuit board.

11. A method for generating a gray-scale drive table, comprising:

collecting a first voltage between a drive electrode of a sub-pixel of a positive-frame and a common electrode as well as a second voltage between a drive electrode of a sub-pixel of a negative-frame and the common electrode in a display panel in each gray-scale;

generating a trigger signal when a voltage difference between the first voltage and the second voltage is greater than a voltage threshold;

adjusting drive gray-scales of the sub-pixel of the positive-frame or the sub-pixel of the negative-frame in response to the trigger signal, so as to make the voltage difference less than the voltage threshold; and generating an adjusted gray-scale drive table according to the drive gray-scales of the sub-pixel of the positive-frame and the sub-pixel of the negative-frame in the gray-scale.

12. The method for generating a gray-scale drive table according to claim 11, wherein the gray-scale drive table comprises a first gray-scale drive table for driving the sub-pixel of the positive-frame and a second gray-scale drive table for driving the sub-pixel of the negative-frame.

13. The method for generating a gray-scale drive table according to claim 11, wherein adjusting drive gray-scales of the sub-pixel of the positive-frame or the sub-pixel of the negative-frame in response to the trigger signal, so as to make the voltage difference less than the voltage threshold comprises: gradually increasing the drive gray-scale of the sub-pixel of the positive-frame according to a first gray-scale interval in response to the trigger signal.

14. The method for generating a gray-scale drive table according to claim 11, wherein adjusting drive gray-scales of the sub-pixel of the positive-frame or the sub-pixel of the negative-frame in response to the trigger signal, so as to make the voltage difference less than the voltage threshold comprises: gradually decreasing the drive gray-scale of the sub-pixel of the negative-frame according to a second gray-scale interval in response to the trigger signal.

15. The method for generating a gray-scale drive table according to claim 11, wherein adjusting drive gray-scales of the sub-pixel of the positive-frame or the sub-pixel of the negative-frame in response to the trigger signal, so as to make the voltage difference less than the voltage threshold comprises:

gradually decreasing the drive gray-scale of the sub-pixel of the negative-frame according to a first gray-scale interval in response to the trigger signal; and gradually decreasing the drive gray-scale of the sub-pixel of the negative-frame according to a second gray-scale interval different from the first gray-scale interval in response to the trigger signal.

16. A method for driving a display panel, comprising:

providing a display panel that comprises a gray-scale drive table generating device, the gray-scale drive table generating device comprising:

a sampling circuit configured to collect a first voltage between a drive electrode of a sub-pixel of a positive-frame and a common electrode as well as a second voltage between a drive electrode of a sub-pixel of a negative-frame and the common electrode in a display panel in each gray-scale;

a processing circuit connected to the sampling circuit and configured to generate a trigger signal when a voltage difference between the first voltage and the second voltage is greater than a voltage threshold;

an adjustment circuit connected to the processing circuit and configured to adjust drive gray-scales of the sub-pixel of the positive-frame or the sub-pixel of the negative-frame in response to the trigger signal to make the voltage difference less than the voltage threshold; and a recording circuit configured to generate an adjusted gray-scale drive table according to the drive gray-scales of the sub-pixel of the positive-frame and the sub-pixel of the negative-frame in the gray-scale, wherein the display panel further comprises a screen driver board connected to the gray-scale drive table generating device, and being configured to drive the sub-pixel of the positive-frame and the sub-pixel of the negative-frame according to the gray-scale drive table;

driving the sub-pixel of the positive-frame according to the first gray-scale drive table; and driving the sub-pixel of the negative-frame according to the second gray-scale drive table.

* * * * *